US006968909B2

(12) United States Patent
Aldred et al.

(10) Patent No.: US 6,968,909 B2
(45) Date of Patent: Nov. 29, 2005

(54) REALTIME CONTROL OF A DRILLING SYSTEM USING THE OUTPUT FROM COMBINATION OF AN EARTH MODEL AND A DRILLING PROCESS MODEL

(75) Inventors: Walter D. Aldred, Thriplow (GB); Richard Meehan, Sugar Land, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 199 days.

(21) Appl. No.: 10/248,704

(22) Filed: Feb. 11, 2003

(65) Prior Publication Data

US 2003/0168257 A1 Sep. 11, 2003

Related U.S. Application Data

(60) Provisional application No. 60/362,009, filed on Mar. 6, 2002.

(51) Int. Cl.[7] ..... E21B 44/00

(52) U.S. Cl. ..... 175/26; 175/27; 175/45; 175/50; 175/61; 175/39

(58) Field of Search ..... 175/24, 26, 27, 175/40, 45, 48, 50, 61, 39, 57; 364/420; 73/150, 151.5; 202/9

(56) References Cited

U.S. PATENT DOCUMENTS

| | | | | |
|---|---|---|---|---|
| 4,794,535 A | * | 12/1988 | Gray et al. | 702/9 |
| 5,842,149 A | | 11/1998 | Harrell et al. | |
| 6,021,377 A | | 2/2000 | Dubinsky et al. | |
| 6,109,368 A | | 8/2000 | Goldman et al. | |
| 6,152,246 A | | 11/2000 | King et al. | |
| 6,192,980 B1 | | 2/2001 | Tubel et al. | |
| 6,206,108 B1 | | 3/2001 | MacDonald et al. | |
| 6,237,404 B1 | | 5/2001 | Crary et al. | |
| 6,256,603 B1 | | 7/2001 | Celniker | |
| 6,408,953 B1 | * | 6/2002 | Goldman et al. | 175/39 |
| 2002/0013630 A1 | | 1/2002 | Siemers | |

FOREIGN PATENT DOCUMENTS

| | | |
|---|---|---|
| GB | 2354852 A | 4/2001 |
| GB | 2354852 B | 11/2001 |
| GB | 2371366 A | 7/2002 |
| GB | 2376769 A | 12/2002 |
| SU | 1086134 | 4/1984 |
| SU | 1231946 | 11/1995 |
| WO | WO 01/25823 A1 | 4/2001 |

OTHER PUBLICATIONS

Varco Drilling Equipment, "Varco's V–ICIS eD™—Integrated Control and Information at Your Fingertips," 2001.
MD Totco, a Varco Company, "Varco Integrated Control and Information System," 1999.
J. Booth, et al., "Meeting Future Drilling Planning and Decision Support Requirements: A New Drilling," SPE/IADC 67816, pp. 1–14.
Search Report under Section 17 dated Jul. 12, 2003 for Great Britain application GB0304839.4.

* cited by examiner

*Primary Examiner*—David Bagnell
*Assistant Examiner*—Daniel P. Stephenson
(74) *Attorney, Agent, or Firm*—Kevin P. McEnaney; Brigitte L. Echols

(57) ABSTRACT

A system is for controlling borehole operations using a computational drilling process model representing the combined effect of downhole conditions and the operation of a drillstring. The drilling process model is continually updated with downhole measurements made during a drilling operation. From the updated drilling process model, a set of optimum drilling parameters is determined and communicated to a surface equipment control system. Further, the system allows the surface equipment control system to automatically adjust current surface equipment control settings based on the updated optimum drilling parameters. Various control scripts are generated and executed to inform the surface equipment control system based on a present drilling mode.

21 Claims, 6 Drawing Sheets

REALTIME CONTROL OF A DRILLING SYSTEM USING THE OUTPUT FROM COMBINATION OF AN EARTH MODEL AND A DRILLING PROCESS MODEL

CROSS REFERENCE TO RELATED APPLICATIONS

This application claims priority to U.S. provisional application No. 60/362,009 filed on Mar. 6, 2002.

BACKGROUND OF INVENTION

1. Field of the Invention

The invention relates generally to the field of hydrocarbon drilling system control. More specifically, the invention relates to optimized performance of various drilling operations based on downhole measurements.

2. Background Art

The drilling of oilwells is controlled by the judgment and direct human actions of the driller operating the mechanical and electrical systems of the drilling rig. The driller will typically directly control at the surface control station, for example, drill pipe speed and position, the vertical force applied to drillstring, the rotary speed of the drillstring and the flowrate of the drilling fluid. These parameters, among others, may be controlled within limits such as the physical limitations of the rig equipment, or in some cases, predefined limits of the input or output parameter, e.g. the torque applied to the drillstring can be limited. The drillers choice of parameters is the result of his general understanding of the feedback responses he gets from the surface equipment, and general observation. This is imperfect information since it does not typically include direct information about the downhole behavior of the drillstring, the formations being drilled or to be drilled, and their relation to the input parameters at surface and the resulting consequences and efficiencies.

On older rigs the control of the drilling parameters is purely manual and relies solely on the driller. New surface drilling control systems are now available which can be programmed to execute an instruction or series of instructions. At present these automated surface control systems are used to control various drilling process segments, for example, such as making a pipe connection. Further, present surface equipment control systems provide that limits be set on certain drilling parameters. However, the limits or values are again a matter of judgment and tend to be a single value per operation per parameter, typically predefined at the initiation of a drilling sequence and without modification or optimization during the drilling process.

Existing controls on the drilling operations provided to a drill operator in many cases restrict maximum efficiency, at least due to the fact that the limit calculations are merely forecasts of the expected drilling properties and earth formations. For this reason, the operations limits, typically provided in absolute parameter values such as an actual rpm, are heavily diluted with error margins. Further, the limits have been developed to generically apply to the entire depth of a borehole, and are not dependent on the specific formation properties encountered.

Approaches have been attempted to refine the limits based on substantial changes to the drilling process. However, even this effort is typically left to human initiative. Thus, to the extent operating guidelines can be modified during the drilling process, substantial risks of human error are introduced into sensitive drilling operations. For this reason, most modifications to drilling processes have been left to the experience of the drilling operator. However, a drill operator's capability to perform certain analyses is limited both by time (limited time to perform testing and calculations) and human ability (limited to relatively simple comparisons). Further, even when a manual analysis is made, the process of implementing a modification introduces error in part due to the drill operator matching to absolute parameter values, many times using analog instrumentation. These limitations in turn introduce inconsistent drilling practices as new drilling operators rotate across work shifts.

To assist in minimizing drilling operation inconsistency, charts have been developed which provide points of reference for some of the drilling parameters. For example, a chart may list a range of drill rpms and a range of downward bit weights to determine an adequate mud flow rate. However, these charts, like the original drilling operations limits, are calculated well in advance of the actual drilling and are thus based on predictions of the drilling conditions. Further, a basic limitation of the charts is due to the inherent finite restriction of the discrete data points, requiring the operator to interpolate between the available data points to fit the actual conditions in order to deduce the proper drilling modification.

SUMMARY OF INVENTION

A system is described for controlling borehole operations using a computational drilling process model representing the combined effect of downhole conditions and the operation of a drillstring. The drilling process model is continually updated with downhole measurements made during a drilling operation. From the updated drilling process model, a set of optimum drilling parameters is determined and communicated to a surface equipment control system.

Further, a system is described which allows the surface equipment control system to automatically adjust current surface equipment control settings based on the updated optimum drilling parameters. Various control scripts are generated and executed to inform the surface equipment control system based on a present drilling mode.

Further, a system is described which includes a drilling process model representing the operational parameters for the drilling control process, downhole formation properties affecting the drilling process and drilling fluid properties affecting the drilling process.

Further, a system is described which receives data from the surface equipment control system, in addition to data from the downhole measurements, to update the drilling process model.

DETAILED DESCRIPTION

The interaction between the drilling process and the earth is key to understanding and controlling the drilling process.

According to one embodiment, downhole measurements are made during the drilling process to dynamically inform an earth model representation of the current downhole drilling environment. The updated earth model along with the current status and operating limits of surface equipment is used to evaluate current drilling modes and inform a surface equipment control system with updated operating parameters, such as operating limits and recommended optimum configuration and settings.

Figure 1:
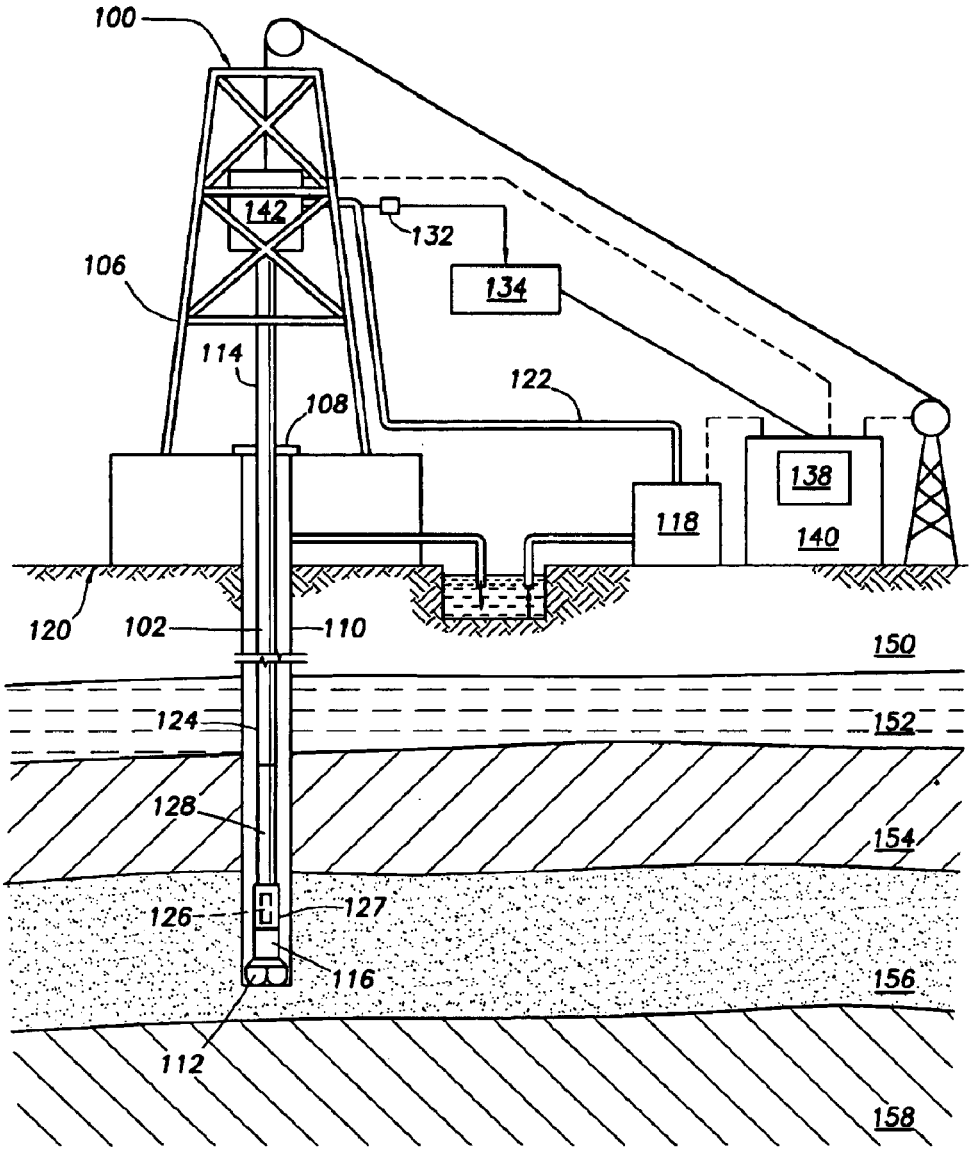
FIG. 1 is an exemplary drill rig configuration.

FIG. 1 illustrates a drilling system 100 that is equipped for communication between a surface control equipment system and down hole measurement systems. As shown in FIG. 1, the drilling system 100 includes a drill string 102 hanging from a derrick 106. The drill string 102 extends through a rotary table 108 into the well 110. A drill bit 112 is attached to the end of the drill string 102, and drilling is accomplished by rotating via the top drive 142 and allowing the weight of the drill string 102 to press down on the drill bit 112 via the winch drive 144 supporting the drill string 102. The drill bit 112 may be rotated by rotating the entire drill string 102 from the surface using the top drive 142 or the rotary table 108 and the kelly 114. The drill bit 112 may alternatively be rotated independent of the drill string 102 by operating a downhole mud motor 116 above the drill bit 112.

While drilling, mud is pumped from mud pumps 118 on the surface 120 through the standpipe 122 and down the drill string 102. The mud in the drill string 102 is forced out through jet nozzles (not shown) in the face of the drill bit 112 and returned to the surface through the well annulus 124, i.e., the space between the well 110 and the drill string 102. One or more sensors or transducers 126 are located in a one or more measurement modules 127 in the bottomhole assembly of the drill string 102 to measure desired downhole conditions. For example, the transducer 126 may be a strain gage that measures weight-on-bit or a thermocouple that measures temperature at the bottom of the well 110. Additional sensors may be provided as necessary to measure other drilling and formation parameters such as those previously described.

The measurements made by the transducers 126 are transmitted to the surface through the drilling mud in the drill string 102. First, the transducers 126 send signals that are representative of the measured downhole condition to a downhole electronics unit 128. The signals from the transducers 126 may be digitized in an analog-to-digital converter. The downhole electronics unit 128 collects the binary digits, or bits, from the measurements from the transducers 126 and arranges them into data frames. Extra bits for synchronization and error detection and correction may be added to the data frames. The signal is transmitted according to known techniques, such as by carrier waveform through the mud in the drill string 102. The various electronics associated with mud pulse telemetry is known and for clarity is not further described. A pressure transducer 132 on the standpipe 122 detects changes in mud pressure and generates signals that are representative of these changes. The output of the pressure transducer 132 is digitized in an analog-to-digital converter and processed by a signal processor 134 which recovers the symbols from the received waveform and then sends the data to a computer 138. Other methods of downhole communication may be employed such as data transmission via wired drill-pipe.

Downhole measurements including drill string data, formation data and other data describing downhole conditions are received by the computer 138, for example, and analyzed manually, for example by a third party oilfield service provider. Reports concerning the downhole data are generated and sent to interested parties, for example a rig operator. This portion of receiving and analyzing downhole data is typically performed separate from automated surface equipment control. To the extent the downhole data reports are used to adjust drilling parameters, this is done manually after the reports have been generated and reviewed by the drilling operators.

A second system called the surface equipment control system 140 is configured to communicate with and control the operation of the various machinery at the well-site. For example, the surface equipment control system 140 transmits control signals and receives feedback from the top drive 142 to adjust and maintain drillstring rpm, the mud pump 118 to adjust the flow of drilling mud through the system and the winch drive 144 to adjust and maintain weight-on-bit. The surface equipment control system may be configured to communicate and control many other surface machinery which affects downhole operations.

FIG. 1 also illustrates a typical drilling operation having multiple formation layers, each potentially exhibiting very different characteristics. Due to these differences, an optimum drilling process may be different for each formation layer. Also, although not shown, different drilling segments, such as directional drilling, may warrant different optimum, and threshold, drilling settings. Downhole measurement systems 126 and 127, are utilized to identify a change in the formation properties and initiate or suggest a modification to the control of the surface equipment. The downhole measurements also indicate current downhole conditions relevant to operation of the drilling process, such as weight on bit, drilling rate, drill bit position and others.

Figure 2:
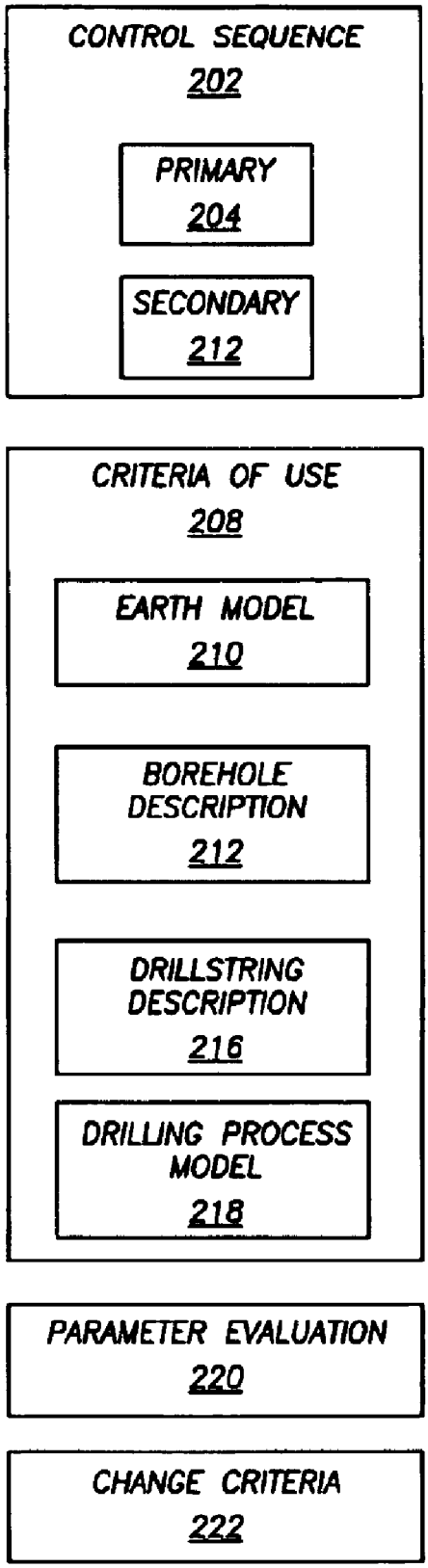
FIG. 2 is a diagram illustrating the software components of the disclosed subject matter.

FIG. 2 conceptually illustrates one approach to implementing the disclosed subject matter. The control process, for example, consists of a script for executing a sequence of control actions and the values of the parameters for each control action. In order to build the control process, according to an embodiment of the disclosed subject matter, the steps are:

1) Determine the sequence of control actions 202
2) The criteria for use 208
3) Evaluation of the parameters 210
4) Criteria for parameter change 212

Determining the sequence of control actions includes primary control for normal operation 204, e.g. drilling, tripping etc., and secondary control for non-normal operation 206, e.g. error conditions such as lost circulation, stuck pipe, excessive vibration. These control actions will be determined by qualified teams or individuals prior to being required, and will be constructed with reference to the earth model of the formation about to be drilled. The control actions will be stored in a database, which is referenced to the same earth model.

For each of the control sequences there will be criteria for use 208. These may be manual, i.e. a person instructs the system to execute a script, or the result of automated analysis, e.g. excessive vibration is detected resulting in an anti-vibration script being run. Each script is entered into the criteria for use 208 module that consists of:

a) Earth Model 212, trajectory independent properties in geological context
b) Borehole description 214, size, location, contents (e.g. mud), orientation
c) Drillstring description 216, geometry and properties etc.
d) Drilling Process Model 218—models the interaction of (a) (c) above, given a particular script. It may consist several components.

The Drilling Process Model is inverted to give the parameters for the control script.

Each control script may have a number of parameter sets, which will be stored in a database linked to the earth model. When these should be changed may be determined manually or automatically. For example, changes may be made to the parameters (e.g. weight on bit) in the drilling script based on the lithology being drilled.

Parameter evaluation 220 includes real time or near real time receipt and analysis of measurements from downhole and surface instrumentation. Parameter evaluation 220 includes standard processing associated with the specific instrumentation included in the drillstring, for example as configured in drillstring description 216. Parameter evaluation 220 may also perform validation processing to ensure the determined properties "make sense" based on the earth model 212 and drilling process model 218, for example for the particular drilling segment or formation layer.

The criteria for parameter change 222 provides the mechanism to effect dynamic modifications to the earth model 212, borehole description 214 and the drilling process model 218. For example, although a particular earth model is initially configured based on expected earth formation layers, if current downhole measurements suggest a new layer or a different depth for an existing layer, the earth model is then updated to reflect this new lithology. The criteria for parameter change 222 provides parameter limits which when compared to the results of the parameter evaluation 220 module effects an update to the appropriate model to account for changing conditions. It should be noted that, from the combination of the earth model 212 and the drilling process model 128, it is possible to estimate the future behavior of the system. It will also be possible to control the current drilling based on some future expected response. This may be useful, for example in extending the life of a bit.

Figure 3:
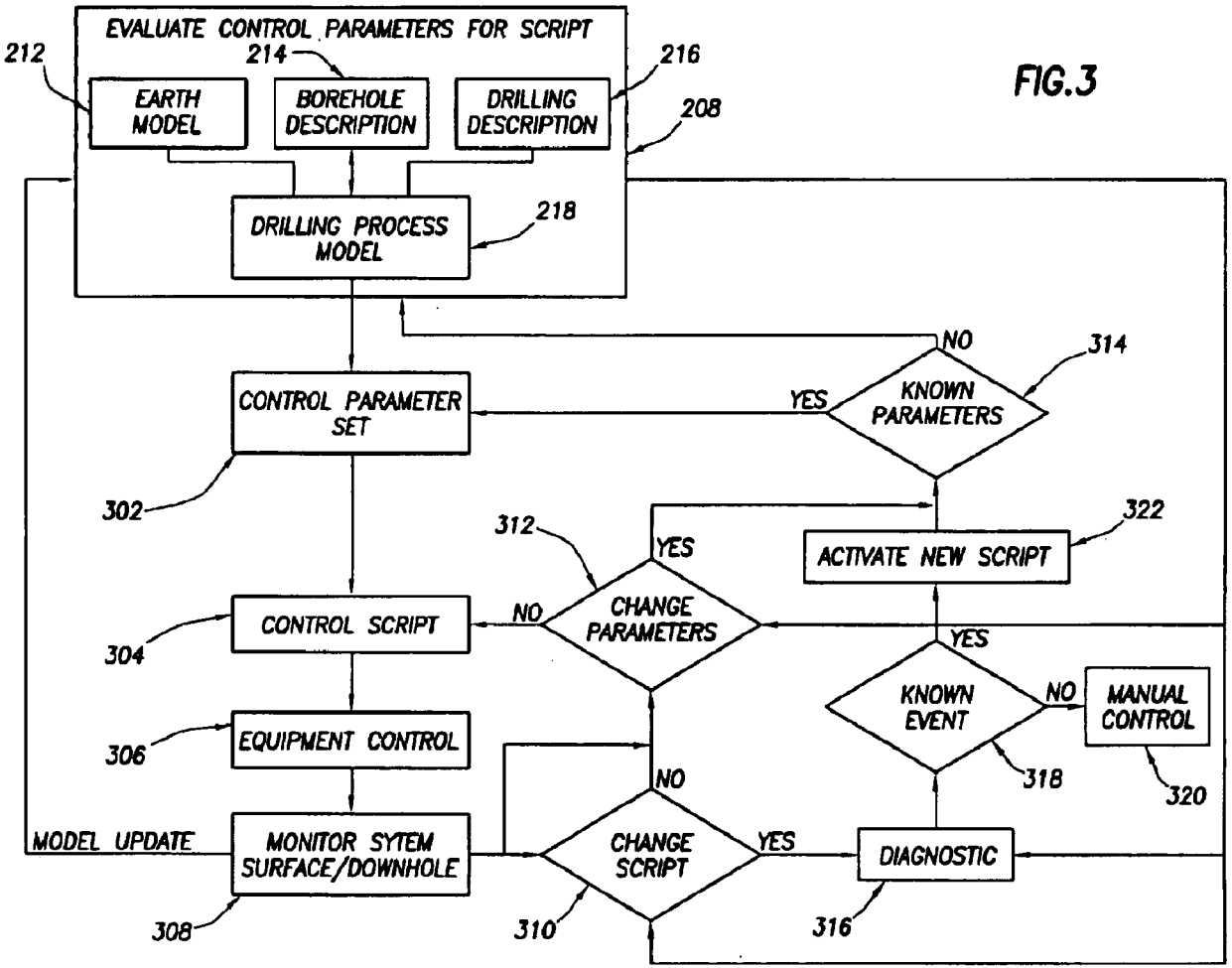
FIG. 3 is a flow diagram for control of the software components of FIG. 2.

Turning to FIG. 3, shown is an exemplary flow process for an embodiment of the disclosed surface equipment control system communication scheme. Beginning at criteria for use module 208, the earth model 212, borehole description 214 and drillstring description 216 are input to the drilling process model 218 to determine a real time or near real time prediction of the current drilling conditions. From the drilling process model 218, a set of current control parameters 302 is output to the currently active control script 304. Based on the input parameters, the control script 304 updates the surface equipment control system interface 306, for example with new optimized operating settings and new threshold values. The process continues to monitor both surface and downhole systems at 308.

The system is designed to dynamically update itself based on the current operating conditions, including response from both surface and downhole equipment. For example, based on present monitoring at step 308, a number of response can be initiated, such at an update to the models of the criteria for use module 208. Further, a presently monitored condition at step 308 may result in a change to execute a different script at step 310. For example, within a tripping operation, if a current set of control parameters indicate normal drilling has resumed, the current tripping script will close and call a drilling script, such as a directional drilling script at step 310. A diagnostic operation is performed at 316, in part to determine the appropriate script for continued drilling, or other operation. In this example, drilling resumption will be recognized as a known drilling process event at step 318 and cause the new script, for example directional drilling, to be automatically executed at step 322. If the new conditions are not recognized at step 318, the system can turn control to the drilling operator, for example with a suggestion for continued operation, at step 320.

In the case where current parameter set does not indicate a need for a change to the current script at step 310, the system. considers whether a change to one or more of the current script parameters requires a change. Such a situation occurs, for example, where within a current drilling mode, the drilling process output approaches a fault threshold, such as a sudden increase in torque during normal drilling. In this example, it may be premature to execute a change to an emergency recovery script, but may be appropriate to increase mud flow to the bit in order to avoid the bit getting stuck. If a parameter change is warranted at 312 or a new script is activated at 322, the parameter set is updated at step 302 to the extent the relevant parameters exist in the system. If the parameters are not available within the current script at step 314, control is returned to the criteria for use module to further update the models for inclusion of the new drilling parameter. for example to transfer current control setting from one script to another, and also to initiate the new script with the most recent determined operating conditions.

Figure 4:
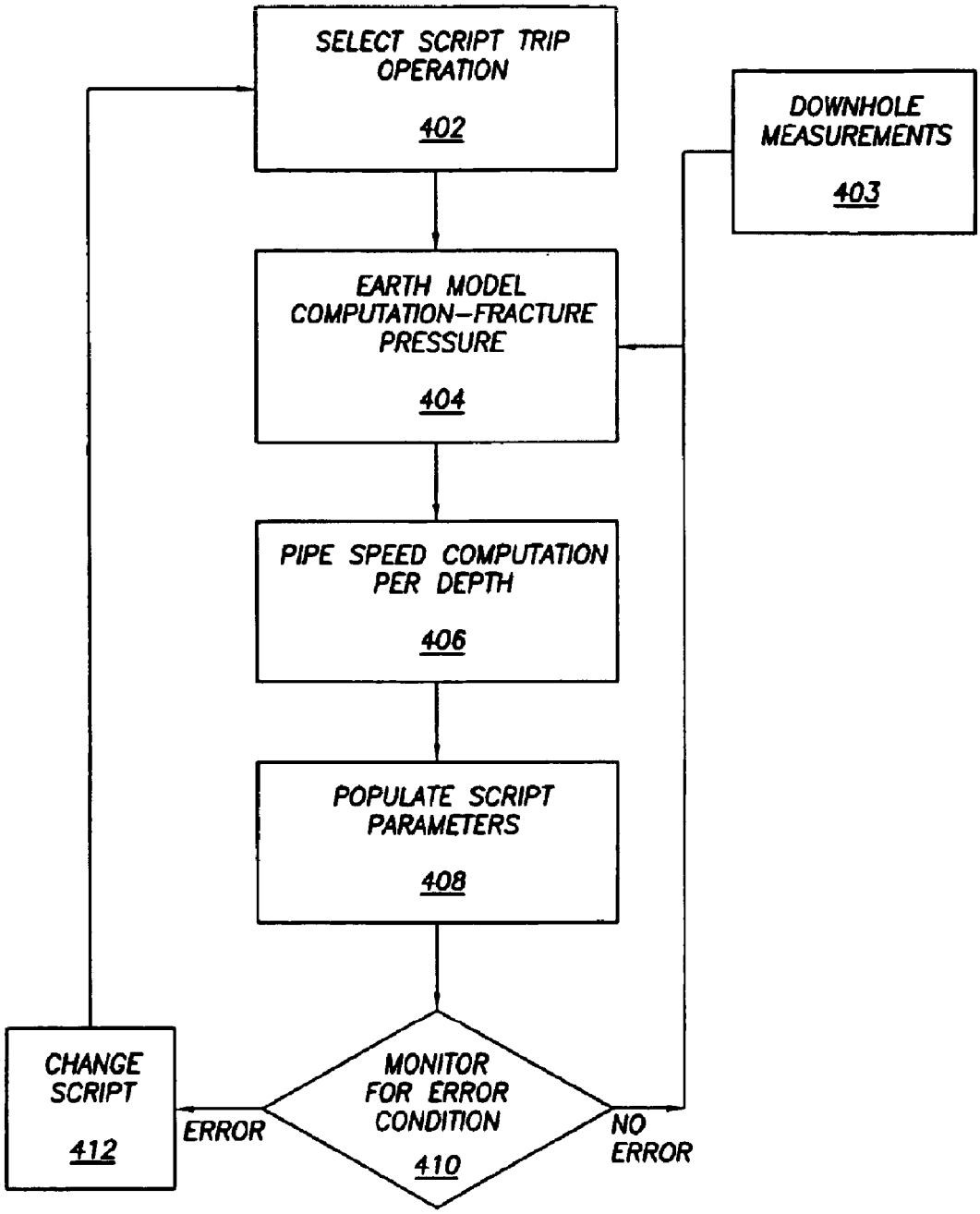
FIG. 4 is a flow diagram for execution of a trip operation utilizing the embodiments of FIGS. 2 and 3.

Implementation of the disclosed subject matter can be illustrated by way of an example illustrated in FIG. 4 to control the pipe speed while tripping pipe into the borehole to avoid lost circulation. First, at step 402, the script "tripping in the hole" is selected to be executed. In the case where the script does not exist, an operator may select an option which allows the script to be custom built. Continuing at step 404, the formation fracture pressure is computed from the earth model and wellbore description for each depth level of the wellbore, or any other maximum pressure constraints. These calculations are based on real time or near real time measurements 403 from downhole instruments of the drill string. A safety margin is applied to give maximum operating pressure. Next at step 406, the pipe speed (from the borehole and drillstring description and drilling fluid properties) is computed, which gives the maximum operating pressure for each level of the wellbore. The script parameter set is populated at step 408 with the computed control parameters—in this case the maximum pipe speed at a given depth. The script is executed while monitoring the wellbore for error condition at step 410. If an error condition is detected at step 412, the script is changed, e.g. if losses occur execute the "lost circulation" script, or exit to manual control.

Figure 5B:
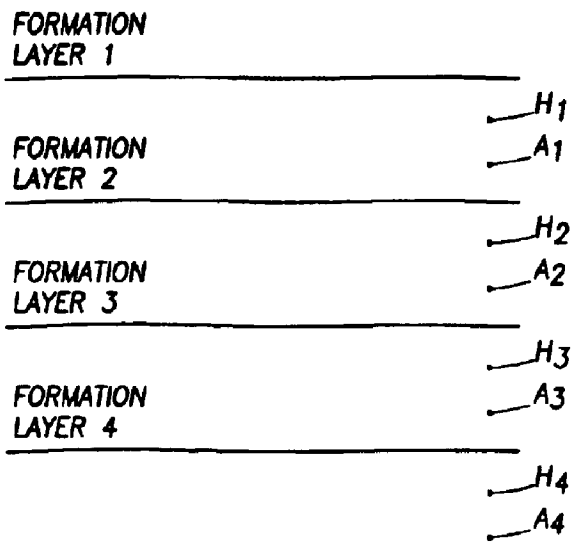
FIG. 5 is a flow diagram for execution of a rate of penetration operation utilizing the embodiments of FIGS. 2 and 3.
Figure 5A:
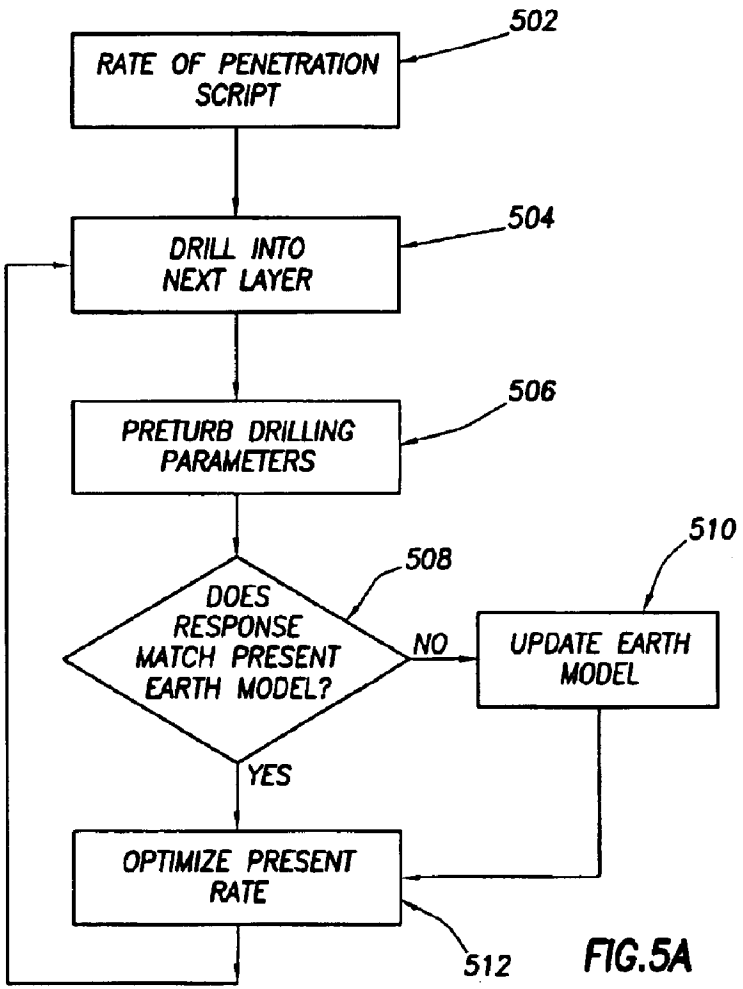

Shown in FIG. 5A is a flow diagram for an embodiment of the disclosed subject matter for controlling a rate of penetration (ROP) operation. Generally, in a drilling operation advancing through a multi-layer formation (shown in FIG. 2B) having varied physical properties, a ROP is determined for the presently drilled layer. Turning specifically to the steps of FIG. 2A, at step 502 a ROP script is called from the surface control station. The drilling operation, for example, may manually initiate the process. The script contains the information of the drilling process model and communicates with the earth model. According to one embodiment, the models are maintained independent of any of the various drilling process scripts. In such case, a script, for example, performs a call requesting the required information from the models.

Drilling begins at step 504 into the first layer of the formation. The script then initiates a sequence at step 506 that perturbs the various drilling parameters causing a physical change in the drilling operation. Examples of drilling parameters include the downward bit weight, the drill string motor rpm, bit position, etc. The drilling parameters are slightly altered in combination with one another according to predetermined algorithms. A feedback loop provides-realtime response to the combination of perturbations. The feedback loop for example can include well known surface and downhole instruments.

From the feedback response, the system utilizes the drilling process model and earth model variables to determine an optimum ROP at step 512 for the presently drilled layer. At step 508, the response measurements are concurrently validated against the present earth model. If variations are detected the earth model is updated at step 510 to reflect the new measurements. This process occurs continuously throughout the first layer drilling process. The script is in continuous, or on-demand, communication with the interface to the surface equipment control system to provide new optimized operating data as it is output by the script.

According to another embodiment, the rate of penetration is optimized across the entire depth of the formation. In this case, the ROP for the present drilled layer is continuously compared to the current earth model, including information for known and forecasted depths, to maximize the overall ROP for the entire formation.

This process provides automatic delineation of drilling performance for a current formation through automatic control of the drilling parameters. Complex optimization algorithms (e.g. monte carlo, etc.) can be continuously applied in realtime. Further, the script is able to execute changes in the drilling process utilizing a dynamic earth model representation in conjunction with a drilling process model.

Thus, provided to a drill operator is a continuously updated range of operation for the ROP process. According to one embodiment, the system provides an output in the form of a minimum level, a maximum level, an optimum level and similar relative set points. However, according to one embodiment, the minimum or maximum levels are not represented as absolute values, i.e. a certain rpm number. This relieves the drilling operator from having to consider the meaning of potentially constantly changing rpm values. Instead, the continuous tweaking to the optimum operating configuration is invisible to the operator. Fully automating a particular process is easily achieved by removing drilling operator intervention altogether (save emergency situations), whereby the script automatically tracks the current optimum configuration.

Another embodiment of the disclosed subject matter can be implemented to automatically control a wiper trip operation. In such a case, a wiper trip script is called either manually or automatically. A wiper trip process is specifically concerned with operating within a range of downhole pressure. If the wiper trip movement is too rapid the attendant pressure drop below the drill bit can inflict destructive forces on the borehole, sometimes unexpectedly causing gas to seep into the borehole.

An exemplary process script computes the maximum movement rate from a host of variables included in the drilling process model and the earth model. Specifically, the drilling process model variable may include hydraulic characteristics relating the liquid properties and pipe motion to downhole pressure. Alternatively, a hydraulics model may be incorporated as a module separate from the earth model and the drilling process model. The hydraulic model, for example, is configured to accurate represent a dynamically active representation of the downhole fluid properties, configured to account for changes in mud properties due to temperature and pressure changes and other factors, including cuttings accumulation.

Actual pressure measurement may be sent from downhole instruments to provide real time drilling process model interaction. The earth model in conjunction with the hydraulic model is utilized to continuously compare the realtime measurements against the current formation variable, e.g. pore pressure, breakout pressure, fracture pressure, etc. Thus, the realtime feedback to the wiper process script provides an operator, or a fully automated controller, wiper rates derived from current drilling conditions. This is an efficiency and safety improvement over past techniques which depended on predetermined limits based on predicted drilling conditions.

Figure 6:
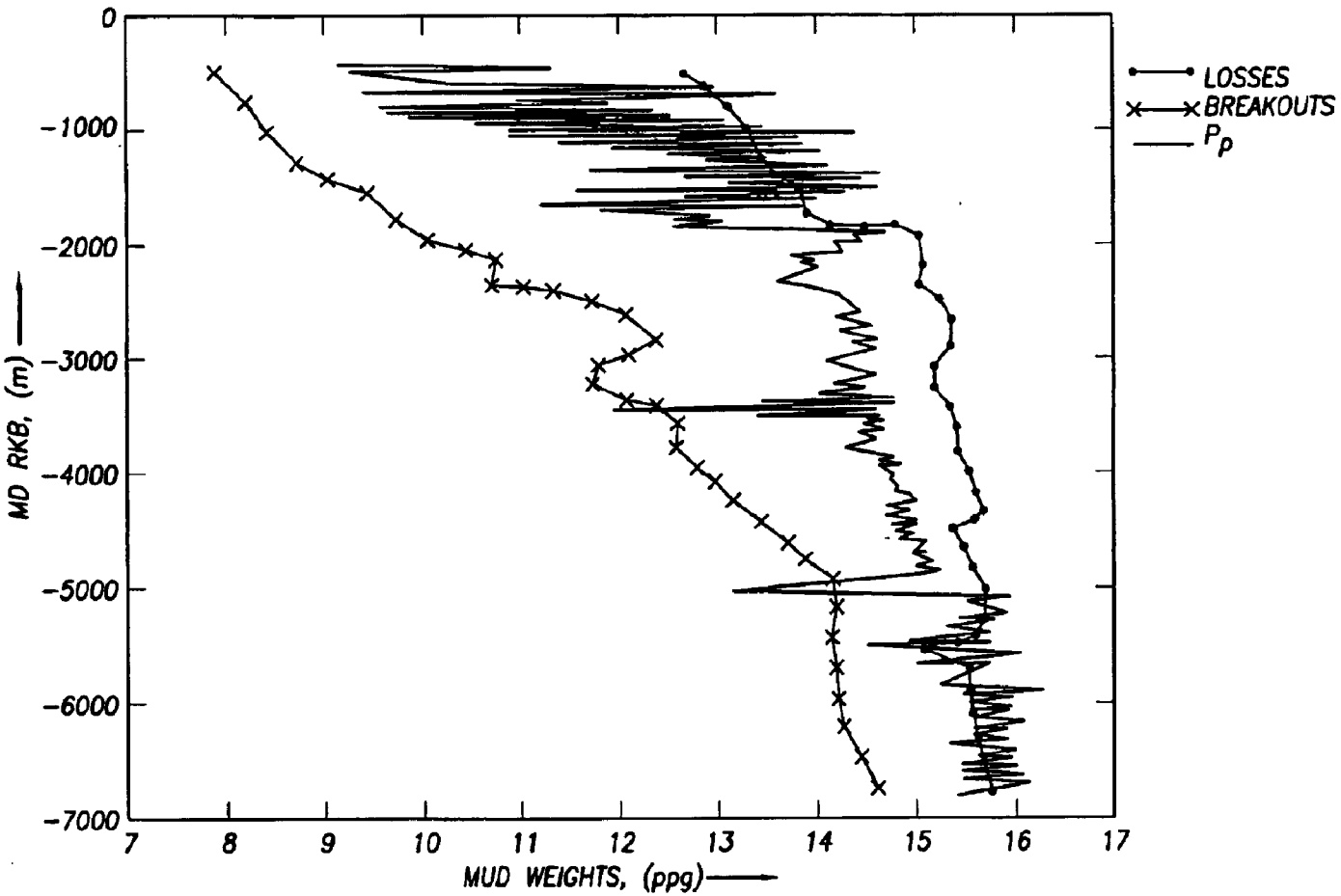
FIG. 6 is a graph for execution of a fracture pressure operation utilizing the embodiments of FIGS. 2 and 3.

An additional embodiment is illustrated below in FIG. 6. FIG. 6 represents an exemplary fracture cross-section of the formation to be drilled. The chart, in one embodiment, is used to select the density of mud and estimate the density operating threshold given a specified mud flow rate. Specifically, the x-axis represents a mud weight in the bore hole along the depth of the hole. Alternatively, the x-axis may utilize pure pressure values instead of mud weight or other pressure gradient.

FIG. 6 illustrates a mud window (i.e. allowable drilling fluid densities) estimated prior to drilling a well. Drilling with a mud (i.e. fluid) whose density falls to the left of the breakout line leads to breakouts. Conversely, drilling with a mud whose density falls to the right of the losses line will cause fluid loss into the formation. The goal is to run a drilling process while maintaining bore pressure to avoid these two extremes. Thus, according to an embodiment, a mud flow script is called from another process script to maintain the proper mud flow into and out of the bore hole. As the drilling process proceeds, realtime down hole measurements are continuously compared with the earth model, including the fracture pressure of the earth and run through computerized optimization algorithms to determine the proper balance between mud flow and the other parameters associated with the particular drilling process being performed.

Exemplary applications have been described for the disclosed automated drilling process control utilizing a dynamic earth model feedback. The processes listed are selected as some of those which are commonly under the control of the drilling operator. However, many other processes (not discussed), such as directional drilling and location drilling (from point X to point Y) and many other drilling parameter variables, such as continuous D&I values, may be automated without departing from the disclosed subject matter.

The present disclosed subject matter offers advantages over past techniques. On a most basic level, the overall drilling efficiency is improved since the process is linked to specific formation properties of the earth model. Further, since these properties are examined and updated during the drilling process, the earth model dynamically validates itself to better represent present and expected drilling conditions. The automated nature allows the drilling process to be continuously optimized according to established, sometimes complex, algorithms, including multi-stage nested loops. Along these lines, the automation extends the optimization process to take into account large historical databases of measurement during the drilling process as well as present measurements being taken which have not been utilized under past techniques.

Continuous feedback of drilling parameters during the drilling process is provided to the automated system in realtime allowing improved consistency and precision in drilling parameter changes, such as, for example, decreased tripping rate or increased rate of penetration. Further, limits can be characterized as floating maximum and minimum set points, such as 90% of a automatically calculated maximum rpm, which are dynamically updated, thus avoiding operator interpretation of a physical limit to an absolute parameter value, such as a certain rpm.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

What is claimed is:

1. A method for controlling a downhole operation, comprising:

constructing a drilling process model to represent an interaction of downhole conditions with an operation of a drillstring;

obtaining a plurality of downhole drilling condition measurements during the downhole operation;

updating the drilling process model based on the downhole drilling condition measurements;

determining a plurality of optimum drilling parameter based on the updated drilling process model;

informing a surface equipment control system of the optimum drilling parameters;

iteratively repeating the steps of obtaining, updating, determining and informing during the downhole operation;

determining a drilling mode; and executing a control sequence script based on the drilling mode.

2. The method as defined in claim 1, the step of constructing further comprising:

populating the drilling process model with parameters representing a geology of the formation surrounding the borehole.

3. The method as defined in claim 1, wherein the step of informing comprises transmitting an output of the control sequence script to the surface control equipment.

4. The method as defined in claim 1, wherein multiple control sequence scripts are ran concurrently.

5. The method as defined in claim 1, wherein the control sequence script performs an operation selected from the group of trip operation, rate of penetration control, fracture pressure control, directional drilling control, location drilling, sliding operation and fishing operation.

6. The method as defined in claim 1, wherein the drilling process model comprises an earth model.

7. The method as defined in claim 1, wherein the drilling process model comprises a hydraulics model.

8. The method as defined in claim 1, wherein the drilling condition measurements comprise formation evaluation measurements.

9. The method as defined in claim 1, the step of updating, further comprising:

updating the drilling process model with based on surface equipment operating data received from the surface equipment control system.

10. The method as defined in claim 1, further comprising:

automatically controlling operation of the surface equipment based on the optimum drilling parameters.

11. A downhole drilling system for determining optimum operating levels for operating surface drilling equipment comprising;

a surface equipment control system interface to communicate with a surface equipment control system a drillstring for drilling a borehole;

a plurality of measurement devices located on the drillstring for obtaining downhole measurements during a downhole operation;

a downhole processing system containing software instructions stored in memory which when executed perform the steps of;

constructing a drilling process model to represent the interaction of downhole conditions with operation of the drillstring;

updating the drilling process model based on the downhole measurements;

determining a plurality of optimum drilling parameters based on the updated drilling process model;

informing the surface equipment control system of the optimum drilling parameters;

iteratively repeating the steps of updating, determining and informing during the downhole operation;

determining a drilling mode; and executing a control sequence script based on the drilling mode.

12. The downhole drilling system of claim 11, the step of constructing further comprising:

populating the drilling process model with parameters representing a geology of the formation surrounding the borehole.

13. The downhole drilling system of claim 11, wherein the step of informing comprises transmitting an output of the control sequence script to the surface control equipment.

14. The downhole drilling system of claim 11, wherein multiple control sequence scripts are ran concurrently.

15. The downhole drilling system of claim 11, wherein the control sequence script performs an operation selected from the group of trip operation, rate of penetration control, fracture pressure control, directional drilling control, location drilling, sliding operation and fishing operation.

16. The downhole drilling system of claim 11, wherein the drilling process model comprises an earth model.

17. The downhole drilling system of claim 11, wherein the drilling process model comprises a hydraulics model.

18. The downhole drilling system of claim 11, wherein the drilling condition measurements comprise formation evaluation measurements.

19. The downhole drilling system of claim 11, the step of updating, further comprising:

updating the drilling process model with based on surface equipment operating data received from the surface equipment control system.

20. The downhole drilling system of claim 11, the processor performing the additional step of:

automatically controlling operation of the surface equipment based on the optimum drilling parameters.

21. The downhole drilling system of claim 11, further comprising;

a surface equipment control system interface for receiving and transmitting data between the surface equipment control system and the downhole processing system.

* * * * *